United States Patent [19]

Heincker

[11] 4,085,678

[45] Apr. 25, 1978

[54] KINETIC ENERGY, IMPACT-SEPARATED, FOLLOW-THROUGH UNGULA PENETRATOR

[75] Inventor: William R. Heincker, Eglin AFB, Fla.

[73] Assignee: The United States of America as represented by the Secretary of the Air Force, Washington, D.C.

[21] Appl. No.: 790,647

[22] Filed: Apr. 25, 1977

[51] Int. Cl.[2] ..... F42B 11/14

[52] U.S. Cl. ..... 102/52

[58] Field of Search ..... 102/92.1–92.7, 102/52

[56] References Cited

U.S. PATENT DOCUMENTS

| | | | |
|---|---|---|---|
| 740,849 | 10/1903 | Groff | 102/52 |
| 927,852 | 7/1909 | Grunwald | 102/52 |
| 3,731,630 | 5/1973 | Muller | 102/52 |
| 3,897,730 | 8/1975 | Riparbelli | 102/52 |
| 3,935,817 | 2/1976 | Riparbelli | 102/52 |

*Primary Examiner*—Harold Tudor

*Attorney, Agent, or Firm*—Joseph E. Rusz; Arsen Tashjian

[57] ABSTRACT

An air dropped penetrator or projectile for a gun, (herein referred to as the munition), adapted for use in fracturing and penetrating a hard concrete target or a similar highly resistant target. In the most basic and generic form, the munition includes: a forward kinetic energy penetrator section, an aft follow-through ungula-shaped penetrator section, and a frangible intermediate section in the form of a tube which releasably interconnects the forward section and the aft section, thereby forming an integrated munition. Upon impact of the munition on the target, the frangible intermediate section breaks, thereby separating from the forward and aft sections, and also separating the forward and aft sections. The forward section fractures the concrete target and penetrates it; and, the aft section follows-through the fractured and penetrated target. Unlike the prior art, separation of this munition into its constituent sections is accomplished without the use of any explosive/propellant to initiate and to cause separation.

1 Claim, 9 Drawing Figures

FIG. 2b
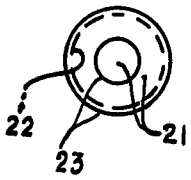
FIG. 2a
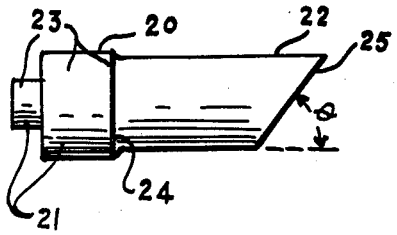
FIG. 2c
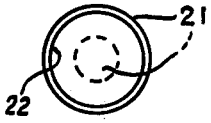
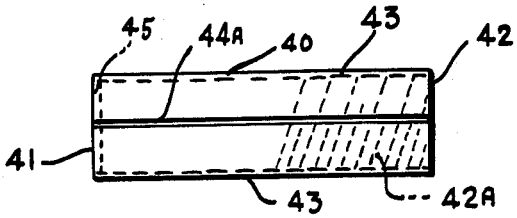
FIG. 4a
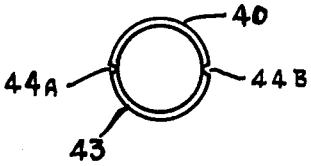
FIG. 4b
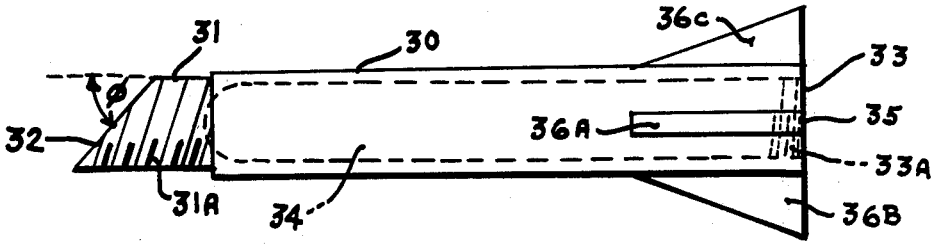
FIG. 3a
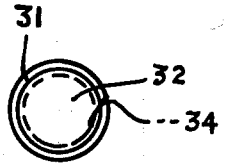
FIG. 3b
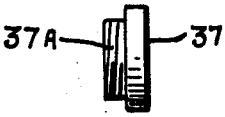
FIG. 3c
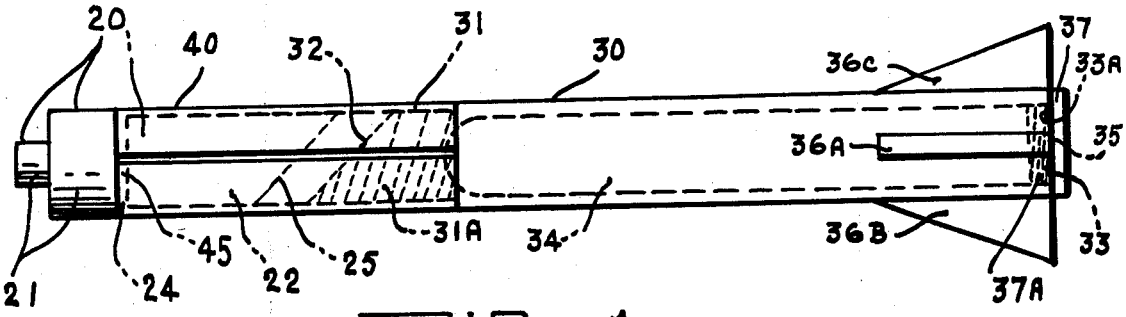
FIG. 1

KINETIC ENERGY, IMPACT-SEPARATED, FOLLOW-THROUGH UNGULA PENETRATOR

STATEMENT OF GOVERNMENT INTEREST

The invention described herein may be manufactured and used by or for the Government for governmental purposes without the payment of any royalty thereon.

BACKGROUND OF THE INVENTION

This invention relates to a munition and, more particularly, to a kinetic energy, impact-separated, follow-through ungula penetrator, adapted for use in penetrating a hard concrete target or a similar highly resistant target.

In its most basic, and generic structural form, my invention comprises a kinetic energy penetrator (hereinafter referred to as the "forward section" of the munition) releasably connected to an ungula-shaped, follow-through penetrator (hereinafter referred to as the "aft section" of the munition) by suitable means, such as will be referred to hereinafter as the "frangible intermediate section" of the munition.

Unlike the prior art, the forward section and the aft section of my unique munition are separated, for penetration of the target, without the use of any explosive/-propellant charge to initiate and/or to cause, the separation.

I have, thereby, significantly advanced the state-of-the-art.

SUMMARY OF THE INVENTION

My invention pertains to an air dropped penetrator or a projectile for a gun, wherein the munition is adapted for use in penetrating a hard concrete target or the like, and wherein the releasably connected forward and aft sections of my munition are separated, for penetration of the target, without the use of any explosive/propellant charge to initiate or cause this separation.

Accordingly, a principal object of this invention is to teach the structure of a preferred embodiment of such a munition.

This principal object, as well as other related objects, of this invention will become readily apparent after a consideration of the description of the invention, together with reference to the Figures of the drawings.

DESCRIPTION OF THE DRAWINGS

FIG. 1 is a side elevation view, in simplified form, partially pictorial and partially schematic, of a preferred embodiment of my inventive munition;

FIGS. *2a, 2b* and *2c* are various diverse views of the forward section component of my inventive munition shown in FIG. 1;

FIGS. *3a* and *3b* are different views of the aft section component of my inventive munition shown in FIG. 1, and FIG. *3c* is a side elevation view of a subcomponent of the aft section component shown in FIGS. *3a* and *3c* of my inventive munition shown in FIG. 1; and FIGS. *4a* and *4b* are different views of the frangible intermediate section component of my inventive munition shown in FIG. 1.

DESCRIPTION OF THE PREFERRED EMBODIMENT

With reference to FIG. 1, therein is shown, in simplified form, a preferred embodiment 10 of my inventive munition.

As previously indicated, in its most basic and generic form, my inventive munition 10 is configurated cylinder-like and comprises: a forward section 20; and aft section 30; and, a frangible intermediate section 40, interposed between, and releasably interconnecting, the forward section 20 and the aft section 30. All three sections 20, 30 and 40 are integrated to constitute and form the munition 10.

With reference to FIGS. *2a, 2b* and *2c*, FIG. *2a* is a side elevation view of the forward section 20 (i.e., the kinetic energy penetrator) of the munition 10, FIG. *2b* is a view from the fore end 21 of the forward section 20, and FIG. *2c* is a view from the aft end 22 of the forward section 20.

Now, with concurrent reference to FIG. 1 and FIGS. *2a, 2b* and *2c*, it is to be noted: that the fore section 21 has an external surface 23 that is tapered 24, preferably at 45°; and that the aft end 22 of the forward section 20 is in the structural form of an ungula having a rear surface 25 inclined at a predetermined angle, such as $\theta$. Additionally, the forward section 20 is preferably made of steel of the 4000 series (i.e., from the art-accepted American Iron and Steel Institute standard Series steel designations) and is heat treated to a Rockwell Hardness of C-36 (i.e., from the art-accepted standard Rockwell Hardness system, wherein prefix letters are used to indicate type of penetrator and load used, and a numeral is used to indicate indirectly the percentage of constituent carbon in the steel).

With reference to FIGS. *3a* and *3b*, FIG. *3a* is a side elevation view of the aft section 30 (i.e., the follow-through penetrator) of the munition 10, and FIG. *3b* is a view from the fore end 31 of the aft section 30.

Now, with reference to FIGS. 1, *3a* and *3b*, it can be seen that the aft section 30 comprises: a threaded 31A fore end 31 in the form of an ungula having a front surface 32 inclined at a predetermined angle, such as $\phi$, with front surface 32 being complementary to rear surface 25 of forward section 20; a closed but openable aft end 33; and, a cavity 34 (sufficient to hold approximately 5 pounds of high explosive or the like, if used in the munition 10) having a mouth (or entrance) 35, with the mouth located at the closed openable aft end 33.

With reference to FIGS. *3c* and 1, it is to be noted that aft section 30 also comprises means 37 for selectively closing and opening the closed openable aft end 33 of the aft section 30. Said means 37 may comprise a plug, as shown, that is threadedly connected (by threads 37A on the plug 37) to the aft end 33 of the aft section 30 (by mating threads 33A internal of aft end 33 that are complementary to plug threads 37A).

Additionally, the aft section 30: is preferably made of steel of the 4000 series; is heat treated to a Rockwell Hardness of C-36; and, is finned, such as by representative fins 36A, 36B and 36C, to stabilize the munition 10 during its free flight delivery to the target.

Further, a fuze mechanism (not shown because it does not comprise a part of this invention) to initiate the high explosive in cavity 34 can be located in the vicinity of the plug 37-cavity mouth 35 interface, internal of the aft section 30.

With reference to FIGS. *4a* and *4b*, FIG. *4a* is a side elevation view of the frangible intermediate section 40 of the munition 10, and FIG. *4b* is a view from the aft end 42 (hereinafter referred to as the "second open end") of the intermediate section 40.

Now, with concurrent reference to FIGS. *4a, 4b* and 1, it can be seen that frangible intermediate section 40 of munition 10 is hollow; is preferably cylinder-like; and has: a first open end 41 (fore); a second open end 42 (aft); and, an external surface 43, with two longitudinal slots 44A and 44B therein, with the slots 44A and 44B oppositely disposed in parallel-spaced relationship, as shown in FIG. 4*a* (i.e., diametrically disposed, if in fact section 40 is a cylinder).

Additionally, frangible intermediate section 40 is also made preferably of 4000 series steel; the first open end 41 is internally tapered 45 to complement the taper 24 on the external surface 23 of the fore end 21 of the forward section 20, FIG. 2*a;* and, the second open end 42 is internally thread-d by and with threads 42A that are complementary to threads 31A of fore end 31 of aft section 30.

It is here to be noted that frangible intermediate section 40 and forward section 20 are releasably connected by a press fit of the internally tapered first open end 41 of the intermediate section 40 onto and over the externally tapered fore end surface 23 of the forward section 20. In FIG. 1, this releasably interconnection can be easily seen. In this regard, in the integrated munition 10, as shown in FIG. 1, the aft end 22 of the forward section 20 is disposed internal of the intermediate section 40.

It is also to be noted that frangible intermediate section 40 and aft section 30 are releasably connected by the mating of threads 31A on and in fore end 31 of aft section 30 with the complementary threads 42A internal of second open end 42 of intermediate section 40. In this regard, in the integrated munition 10, as shown in FIG. 1, the fore end 31 of the aft section 30 is disposed internal of the intermediate section 40.

MANNER OF OPERATION OF THE PREFERRED EMBODIMENT

The manner of operation of the preferred embodiment 10 of my inventive munition can be ascertained very easily by a person of ordinary skill in the art from the foregoing description, together with reference to the Figures of the drawings.

For others, it is sufficient to say in explanation, that what occurs, in sequence, after the munition 10 has impacted the hard concrete target is as follows: the frangible intermediate section 40 breaks (i.e., fails and splits) along the grooves 44A and 44B, thereby separating itself (in two halves) from the forward section 20 and the aft section 30; the inclined rear surface 25 of the forward section 20, and the inclined front surface 32 of the aft section 30, abut; the forward section 20 fractures the hard concrete target and makes a penetration into and through the target; and, the aft section 30 passes into and through the fractured and penetrated hard concrete target.

CONCLUSION

It is abundantly clear from all of the foregoing, and from the contents of the Figures of the drawings, that the stated principal object, as well as other related objects, of my inventive munition have been attained.

It is to be noted that, although there have been described the fundamental and unique features of my invention as applied to a particular preferred embodiment, various other embodiments, adaptations, substitutions, additions, omissions, and the like, may occur to, and can be made by, those of ordinary skill in the art, without departing from the spirit of my invention.

What is claimed is:

1. A munition, adapted for use in penetrating a hard concrete target, comprising:

a. a forward section having a fore end, and a cylinder-like aft end of preselected diameter and in the structural form of an ungula having a rear surface inclined at a predetermined angle;

b. an aft section comprising:

(1) a threaded, cylinder-like fore end of the same diameter as said aft end of said forward section, and in the structural form of an ungula having a front surface inclined complementary to said inclined rear surface of said aft end of said forward section;

(2) a closed openable aft end that is finned;

(3) a cavity having a mouth, with said mouth located at said closed openable aft end;

(4) and, a plug threadedly connected to said closed openable aft end for selectively closing and opening said aft end;

c. and, a hollow cylinder-like frangible intermediate section interposed between, and releasably interconnecting, said forward section and said aft section, wherein said intermediate section has:

(1) a first open end into which said aft end of said forward section is press fitted;

(2) a second open end, threaded complementary to said threaded fore end of said aft section, into which the said threaded fore end of said aft section is threadedly fitted;

(3) and, an external surface with two horizontal grooves therein, with said grooves oppositely disposed in parallel-spaced relationship;

whereby said forward section, said aft section, and said interconnecting intermediate section are integrated to form a single cylinder-like configurated munition;

and, whereby upon impact of said forward section with said hard concrete target, said intermediate section breaks along said grooves and separates from said forward section and also from said aft section, and said forward section fractures the hard concrete target and makes a penetration therein and therethrough, and thereafter said aft section passes into and through said fractured and penetrated hard concrete target.

* * * * *